United States Patent [19]

Kato

[11] Patent Number: 4,565,762

[45] Date of Patent: Jan. 21, 1986

[54] APPLICATOR FOR RELEASING AGENT

[75] Inventor: Chiaki Kato, Osaka, Japan

[73] Assignee: Sumitomo Electric Industries, Ltd., Osaka, Japan

[21] Appl. No.: 649,762

[22] Filed: Sep. 12, 1984

[30] Foreign Application Priority Data

Sep. 30, 1983 [JP] Japan ..... 58-183468

[51] Int. Cl.[4] ..... G03G 13/20; B05C 11/00

[52] U.S. Cl. ..... 430/99; 118/60; 118/260; 118/264; 219/216; 355/3 FU; 432/60; 430/124; 427/429

[58] Field of Search ..... 430/99, 124; 118/60, 118/260, 264; 355/3 FU; 432/60; 219/216; 427/429

[56] References Cited

U.S. PATENT DOCUMENTS

| | | | |
|---|---|---|---|
| 4,075,362 | 2/1978 | Concannon | 430/99 |
| 4,287,280 | 9/1981 | Swift | 430/99 |
| 4,458,625 | 7/1984 | Sakane et al. | 118/60 |

*Primary Examiner*—Michael R. Lusignan
*Attorney, Agent, or Firm*—Staas & Halsey

[57] ABSTRACT

An apparatus and a method for applying a releasing agent to a fixation roller so that toners are not undesirably built up on the rollers and unwanted spots on a document being reproduced are avoided. The releasing agent includes a polypropylene powder dispersed in silicone oil wherein the powder and oil are heated to raise the powder to a molten state and the powder and oil are then cooled forming fine particles of polypropylene powder that do not tend to float on the top of the silicone oil.

8 Claims, 2 Drawing Figures

APPLICATOR FOR RELEASING AGENT

BACKGROUND OF THE INVENTION

The present invention relates to an applicator for a releasing agent. More particularly, the present invention relates to an apparatus for applying a releasing agent such as a silicone oil to a fixing roller of a copying machine such as a plain paper copy machine.

FIG. 1 illustrates a conventional fixing portion of a copy machine. In such a machine the releasing agent is applied to a fixing roller 1 and to a pressure roller 2. The releasing agent prevents adhesion of toners 4 to the fixing roller 1 and twining of paper 3 around the fixing roller. Typically, dimethyl polysiloxane for example, KF #96 manufactured by Shine-estu Silicone Co., Ltd. or SH 200 manufactured by Toray Silicone Co., Ltd., have been used as releasing agents.

In recent copy machines the amount of silicone oil has been generally reduced. The reduction saves on the amount of silicone oil used, minimizes spotting of the copy paper 3 and reduces formation of silicone oil spots on the portion adjacent to the fixing roller 1. To reduce the amount of silicone oil used, it is usual to apply the silicone oil by passing it through a material such as tetrafluoroethylene resin porous material; for example, Poreflone® manufactured by Sumitomo Denko Co., Ltd.

However, reducing the amount of silicone oil applied is difficult. For example, if the amount of silicone oil applied is excessively small, a lack of silicone oil results when copying under severe copying conditions such as when copying is continued for a long time period or the document to be copied is of the type requiring a large amount of toner. Such conditions result in the toner 4 being undesirably stored at the front portion of blade 6 and a portion of the stored toner passing the blade 6 causing unwanted spots on the picture being reproduced on the copy paper.

SUMMARY OF THE INVENTION

An object of the present invention is to avoid the above problems associated with a conventional copier.

Another object of the present invention is to avoid unwanted spotting on the reproduced document.

Still another object of the present invention is to avoid passing undesirably stored toner to the copy paper and causing spots on the reproduced document.

To achieve the above other object, the present invention applys a releasing agent to a heated fixation roller through a tetrafluoroethylene resin porous material, wherein the releasing agent comprises polypropylene powder dispersed in said silicone oil which is then brought to a molten state and subsequently cooled to form a fine polypropylene powder.

DETAILED DESCRIPTION OF THE PREFERRED EMBODIMENT

Figure 1:
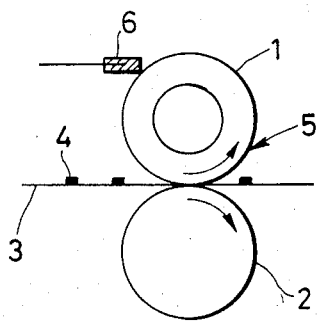
FIG. 1 is a side view of a fixing apparatus of the present invention.
Figure 2:
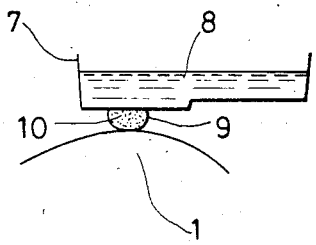
FIG. 2 is sectional side view of the fixing portion of the apparatus illustrated in FIG. 1.

FIG. 2 is a sectional side view of an embodiment of the present invention showing an applicator for applying a releasing agent. In FIG. 2, reference numeral 1 denotes a fixing roller; reference numeral 7 indicates a tank for receiving a releasing agent; reference numeral 8 denotes a releasing agent; and reference numeral 9 denotes a sheet of tetrafluoroethylene resin porous material formed to contain the releasing agent 8. The releasing agent is applied to the fixing roller 1 by passing through the tetrafluoroethylene resin porous material 9. Reference numeral 10 denotes heat-proof felt enclosed within the porous material 9. The heat-proof felt maintains the form of the porous material 9 and holds the silicone oil.

According to the present invention, the releasing agent 8 is fabricated in such a manner that the polypropylene powder has a molecular weight in a range of 3000 to 4000; for example, a powder having a trademark for Viscole manufactured by Sanyo Chemical Industries, Ltd. The polypropylene powder is dispersed in the silicone oil and heated to a molten state by heating the oil and powder to a temperature above 150° C. which is the melting point of the polypropylene. The molten polypropylene is then cooled to make a fine powder dispersant of the polypropylene. The releasing agent 8 applied to the fixing roller 1 by passing through the porous material 9 and then being heated to a molten state by the fixing roller 1 which is heated to a temperature in the range of 170° to 200° C., above the 150° C. melting point of the polypropylene powder.

If the polypropylene powder is not molten and is used in its normal state, then the polypropylene powder undesirably floats on the surface of the silicone oil for a short time. The present invention avoids such a problem.

In the above embodiment the porous material 9 is illustrated as being a sheet, however, it may also have a tube shape. Typical tube shapes are shown in Japanese Patent Laid-Open Application No. 56-161570.

The tetraflouroethylene resin porous material is fabricated in a manner such that the mixture of tetraflouroethylene resin and silicone oil used as a lubricating agent is made into a sheet or tube by using a calender rolling machine and is then sintered. Such fabricated material has fine, well controlled and uniform diameter pores; the diameters being in the range of 0.1 to 10 μm. The porosity of such material is in range of 40 to 85%. A poreflone sheet or poreflone tube can be used as the tetraflouroethylene resin material, such as manufactured by Sumitomo Denko Co., Ltd. Typical uses of such a material are shown in Japanese Patent Publication No. 42-13560, and Japanese Patent Application No. 50-155226.

In a particular application of the present invention, the polypropylene powder (Viscose 660-N) of 0.2% was dispersed in silicone oil (KF #96, 10,000CS) and brought to a molten state at a temperature of approximately 200° C., and then cooled to make the polypropylene powder into fine particles to obtain a dispersant without dispersion for the silicone oil. The releasing agent thus fabricated was placed in the applicator using the tetroflouroeythlene porous material as shown in FIG. 2. The application of the releasing agent was studied to determine the accumulation of the toner 4 on the blade 6 and spotting of the copy paper 3. Continuous operation of a copying machine resulted in only 0.2 to 0.4 g per 500 sheets of copy paper of silicone oil being applied to the fixing roller. The 500 sheets of copy paper were feed in the 5 groups of 100 sheets.

Test results showed that when the releasing agent comprises only silicone oil, spots are formed on the back surface of the copy paper. The spots occurred after copying only 200 to 500 sheets. In contrast, when the releasing agent of the present invention was employed, spots did not form on the back surface of the copy paper, even after copying 4000 to 5000 sheets.

When polypropylene powder that was not melted to form a fine powder is used in the dispersion, the powder tends to float on the silicone oil after only about 1 hour. However, when powder that has been molten is used, the fine powder does not float even after a long time period. Further, if polypropylene powder is used above 2%, dispersion is caused upon melting of the powder, and block of the powder is undesirably collected on the upper portion of the silicone oil upon cooling.

As mentioned above, the present invention improves the releasing performance of the toner and the offset phenomenon is avoided. Further, the toner stored on the front portion of the gate 6 is caused to bunched in a block and is prevented from passing the blade. The present invention is not limited use with a plain paper copying machine, but may be used with machines such as line printers or facsimile machines.

What is claimed is:

1. An applicator for applying a releasing agent to a heated fixation roller, said applicator comprising:

a releasing agent including polypropylene powder dispersed in silicone oil which is heated to bring the polypropylene to a molten state;

holding means for holding said releasing agent; and a porous resin material for transferring said releasing agent from said holding means to the fixation roller.

2. An applicator for applying a releasing agent according to claim 1, wherein said releasing agent includes polypropylene powder dispersed in said silicone oil at room temperature and the polypropylene powder is brought to a molten state by heating the powder to a temperature above the melting point of said polypropylene powder, and then cooling the polypropylene to form fine powder particles.

3. An applicator for a releasing agent according to claim 1, wherein said porous resin material comprises tetraflouroethylene and has pores formed therein having diameters in the range of 1–10 μm and said porous material has a porosity in the range of 50–85%.

4. A method of applying a releasing agent to a heated fixation roller comprising the steps of:

(a) dispersing a polypropylene powder in silicone oil;

(b) heating the dispersed polypropylene powder in the silicone oil to a temperature greater than the melting point of said polypropylene powder;

(c) cooling said heated polypropylene powder to form a fine particle polypropylene powder; and (d) applying said fine particle polypropylene powder dispersed in said silicone oil to the heated fixation roller.

5. A method of applying a releasing agent according to claim 4, wherein step (d) includes applying said fine particle polypropylene powder dispersed in said silicone oil to the heated fixation roller via a tetraflouroethylene resin porous material.

6. A method of applying a releasing agent according to claim 5, wherein said polypropylene powder has molecular weight in the range of 3000–4000.

7. A method of applying a releasing agent according to claim 6, wherein the pores of said porous material have diameters in the range of 1–10 μm, and said porous material has a porosity in the range of 50–85%.

8. A method of applying a releasing agent according to claim 7, wherein said heated fixation roller is heated to a temperature in the range of 170° C.–200° C.

* * * * *